US005413046A

United States Patent [19]

Sobczak et al.

[11] Patent Number: 5,413,046

[45] Date of Patent: May 9, 1995

[54] SHOCK TUBE ASSEMBLY

[75] Inventors: Brian R. Sobczak, Granby; Frank J. Lucca, North Granby; J. Donaldson Thomas, Simsbury; Craig F. Adams; Ernest L. Gladden, both of Granby, all of Conn.

[73] Assignee: The Ensign-Bickford Company, Simsbury, Conn.

[21] Appl. No.: 212,200

[22] Filed: Mar. 11, 1994

[51] Int. Cl.[6] ..... C06C 5/04

[52] U.S. Cl. ..... 102/275.7; 102/275.3; 102/275.5

[58] Field of Search ..... 102/275.1, 275.2, 275.3, 102/275.4, 275.5, 275.6, 275.7, 275.8, 275.12

[56] References Cited

U.S. PATENT DOCUMENTS

| | | | |
|---|---|---|---|
| 746,262 | 12/1903 | Gillies | 102/275.12 |
| 1,996,855 | 4/1935 | Cheswright | 285/239 |
| 3,057,296 | 10/1962 | Silverman | 102/275.5 |
| 3,169,480 | 2/1965 | Seavey | 102/275.1 |
| 3,469,863 | 9/1969 | Riester et al. | 285/137.1 |
| 3,590,739 | 7/1971 | Persson | 102/275.5 |
| 3,706,277 | 12/1972 | Willard et al. | 102/275.3 |
| 3,767,233 | 10/1973 | Hodge | 285/239 |
| 3,774,541 | 11/1973 | Bratton | 102/275.1 |
| 3,981,240 | 9/1976 | Gladden | 102/275.5 |
| 3,987,732 | 10/1976 | Spraggs et al. | 102/275.5 |
| 4,328,753 | 5/1982 | Kristensen et al. | 102/275.8 |
| 4,597,594 | 7/1986 | Kacalieff et al. | 285/239 |
| 4,607,573 | 8/1986 | Thureson et al. | 102/275.8 |
| 4,757,764 | 7/1988 | Thureson et al. | 102/312 |
| 4,771,694 | 9/1988 | Bartholomew et al. | 102/275.7 |

*Primary Examiner*—David Brown

*Attorney, Agent, or Firm*—Victor E. Libert; Frederick A. Spaeth

[57] ABSTRACT

A signal transmission tube assembly includes a signal transmission tube, such as a coil of shock tube on a spool, having opposite terminal ends and containing a reactive material. The open terminal ends of the shock tube provide the sole exits for the signal generated therein and the sole entry points for contaminants. Sealing means seal both terminal ends of the signal transmission tube against escape from the assembly of the signal engendered by initiated reaction of the reactive material, and protects the interior of the signal transmission tube from contamination. The sealing means may be a releasable sealing means which can be actuated to release the transmission tube from it, thereby facilitating re-use of the sealing means. Further, the sealing means may comprise a surge chamber to relieve pressure engendered by reaction of the reactive material and thereby militate against rupture of the signal transmission tube and consequent release from the assembly of a signal. A signal-rupturable diaphragm may be interposed between the signal transmission tube and the surge chamber.

14 Claims, 3 Drawing Sheets

SHOCK TUBE ASSEMBLY

BACKGROUND OF THE INVENTION

1. Field of the Invention

The present invention is concerned with signal transmission tube assemblies, such as coils of shock tube on a spool, which assemblies include sealing means for improved safety in shipping and storage. More specifically, the present invention is concerned with signal transmission tube assemblies having the open or terminal ends thereof sealed to reduce the hazard of unintended ignition and that of contamination of the signal transmission tube.

2. Related Art

The use of signal transmission lines or tubes, such as those commonly referred to-as "shock tube" is, of course, well-known in the art. It is conventional practice in the manufacture of signal transmission tube to coil the tube on large spools which may contain as much as ten thousand linear feet (about 305 meters) of the signal transmission tube. Signal transmission tube, as is well-known, comprises hollow tubing usually made of synthetic organic polymeric materials (plastics) and contains on the interior wall thereof a coating of a reactive material. In the case of shock tube, the reactive material contains a pulverulent high explosive. The coating of reactive material on the interior wall is quite thin and leaves the tube hollow, providing an open channel or bore extending through the length of the shock tube. When the reactive material is initiated as by a spark igniter or any other suitable means, the reaction of the reactive material propagates an initiation signal through the bore of the tube. If the tube is properly connected to a device such as a detonator cap, the signal emerging from a terminal end of the shock tube will initiate the detonator cap. Patents which illustrate the construction and manufacture of shock tube include U.S. Pat. No. 3,590,739 issued Jul. 6, 1971 to P. A. Persson, U.S. Pat. No. 4,328,753 issued May 11, 1982 to L. Kristensen et al and U.S. Pat. No. 4,607,573 issued Aug. 26, 1986 to G. R. Thureson et al. As disclosed in the Thureson et al Patent, the reactive material of a shock tube may comprise a thin coating or dusting of a mixture of high brisance explosive such as PETN, RDX, HMX or the like, and a fine aluminum powder. The tube of the shock tube may be a plural layer tube. For example, as disclosed in the Kristensen et al Patent, the tube may comprise an inner or sub-tube such as a SURLYN ionomer plastic and the outer tube may be made of a mechanically tougher material such as a low or medium density polyethylene. (SURLYN is a trademark of E. I. Du Pont de Nemours & Co. for its ionomer resins.)

U.S. Pat. No. 4,757,764 issued Jul. 19, 1988 to G. R. Thureson et al discloses signal transmission tubes as described above except that the reactive material is a low velocity deflagrating material instead of an explosive powder of high brisance. The use of a deflagrating material reduces the speed of transmission of the initiation signal propagated through the tube as compared to shock tubes. Such deflagrating material tubes are usually referred to in the art as low velocity signal transmission lines or tubes ("LVST tubes"). A large number of deflagrating materials are disclosed in U.S. Pat. No. 4,754,764, including manganese/potassium perchlorate, silicon/red lead and zirconium/ferric oxide, to name but a few of the many compositions disclosed starting at column 3, line 48 of the Patent. As pointed out at column 4, line 47 et seq of that Patent, whereas shock tubes, when ignited, produce a "shock wave initiation signal" which travels through the tube, the LVST tubes transmit an initiation signal by means of a "pressure/-flame front" principle. Nonetheless, both types of tubes, shock tubes and LVST tubes, may be utilized as signal transmission lines and both emit a signal from an open, terminal end of the tube.

SUMMARY OF THE INVENTION

In accordance with the present invention, there is provided a signal transmission tube assembly which comprises a signal transmission tube having opposite terminal ends and containing a reactive material, and sealing means connected to both terminal ends of the signal transmission tube. The sealing means serves to seal the assembly against escape therefrom of a signal engendered by reaction of the reactive material. Optionally, the signal transmission tube may be coiled on a spool.

In one aspect of the present invention, the sealing means may comprise an inert closure means affixed to each of the opposite terminal ends. For example, a more specific aspect of the present invention provides that the sealing means may comprise an inert closure means having one end of a length of inert tubing sealed thereto, and a union connector sealing the other end of the length of inert tubing to a terminal end of the signal transmission tube. The union connector places the inert tubing in signal communication relation with the signal transmission tube.

In accordance with another aspect of the present invention, the sealing means comprises a first inert closure means affixed to one terminal end, and a second inert closure means affixed to the other terminal end.

Other aspects of the invention provide, separately or in combination, that the sealing means comprises a releasable sealing means which is capable of being actuated to release the signal transmission tube from the sealing means; and/or that the sealing means comprises a surge chamber connected in signal communication with the signal transmission tube; and/or that a signal-rupturable diaphragm be interposed between the signal transmission tube and the surge chamber.

Yet another aspect of the present invention provides for a signal transmission tube assembly comprising the following components: a signal transmission tube having opposite terminal ends and containing a reactive material, a first sealing means connected to one terminal end of the signal transmission tube and a second sealing means connected to the other terminal end of the signal transmission tube. The first and second sealing means serve to seal the assembly against escape therefrom of a signal engendered by reaction of the reactive material, and at least one of the first and second sealing means comprises an inert closure means having a surge chamber connected in signal communication with the signal transmission tube.

Other aspects of the invention will become apparent from the following description.

DETAILED DESCRIPTION OF THE INVENTION AND PREFERRED EMBODIMENTS THEREOF

Figure 1:
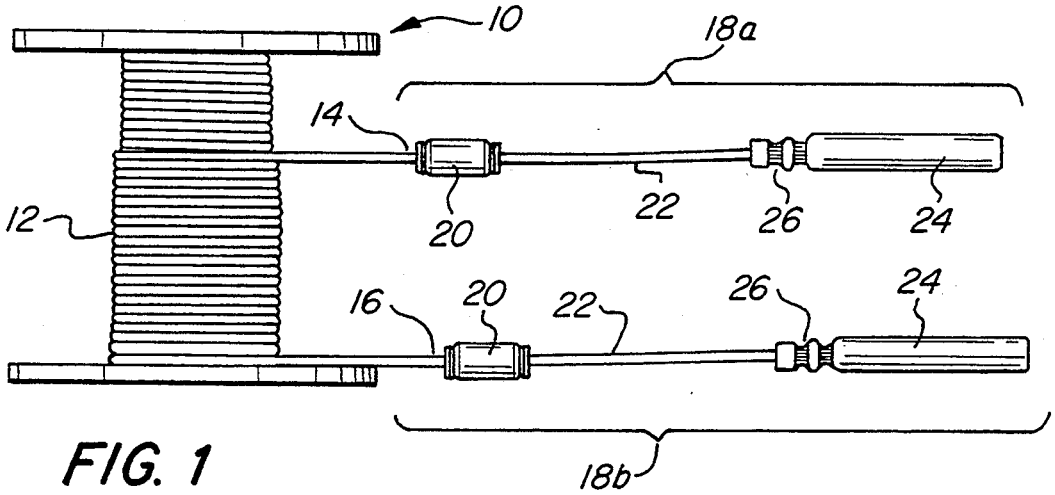
FIG. 1 is a schematic elevational view of a signal transmission tube assembly comprising, in accordance with one embodiment of the present invention, a spool of signal transmission tube fitted with sealing means.

Currently, the U.S. Department of Transportation has classified open-ended spools of shock tube as hazardous material based on the possibility that if a spool of shock tube is inadvertently initiated, the signals which emanate from the terminal ends of the tube may ignite nearby material such as an adjacent spool of shock tube, for example, by igniting the open terminal end of the adjacent spool By classifying shock tube as a hazardous material, i.e., as Articles, Explosives, nos. 1.4S, UN 0349, the Department of Transportation has imposed significant burdens in connection with the transportation and storage of shock tube, including packaging requirements and restrictions on the types of other hazardous materials that may be shipped together with shock tube.

To escape the classification of shock tube as a hazardous material, it is necessary to reduce the possibility that an inadvertent initiation can be passed from the open terminal end of one shock tube to another, or to another material. Accordingly, the present invention provides a signal transmission tube assembly in which the opposite terminal ends of the signal transmission tube, such as shock tube, are sealed by sealing means. The sealing means serves to prevent the escape from the signal transmission tube assembly of an initiation signal resulting from a reaction of the reactive material contained within the signal transmission tube. Conversely, the sealing means prevents or inhibits the introduction of an initiating signal or reaction into the open terminal end of the tube. The construction of the present invention contrasts with conventional construction of a detonator device wherein one end of a length of signal transmission tube is sealed and the other end is fitted within a conventional detonator cap. In the conventional construction, the signal generated by reaction of the reactive material within the sealed signal transmission tube, whether the reaction was intended or not, escapes from the assembly in amplified form by the detonation of the detonator cap.

The sealing means of the present invention also serves to prevent the spillage of loosened reactive material from the interior of the signal transmission tube, and to protect the interior of the tube from environmental contamination.

One embodiment of sealing means in accordance with the present invention provides a surge chamber at the end of the shock tube to contain the gaseous flame front of the signal which emerges from the signal transmission tube, thereby reducing or eliminating the prospect of the blocked signal rupturing the signal transmission tube or the sealing means, or dislodging the sealing means from the terminal end of the signal transmission tube. A surge chamber may be provided in a variety of ways, such as by securing a hollow plug to the terminal end of the signal transmission tube, or by coupling the terminal end of the signal transmission tube to the open end of an inert length of tubing that is closed at the other end, or by other means as described below.

There is shown in FIG. 1 a signal transmission tube assembly in accordance with one embodiment of the present invention. The assembly comprises a spool 10 that carries a quantity, for example, about ten thousand feet (about 305 meters), of a single length of signal transmission tube 12 having reactive material disposed therein throughout the length thereof. Signal transmission tube 12, which may be shock tube containing a reactive material comprised of a pulverulent high brisance explosive and fine aluminum powder, has a first terminal end 14 and a second terminal end 16. Attached to first terminal end 14 is a sealing means **18*a* and attached to second terminal end 16 is a sealing means 18*b* which is similar or identical to sealing means 18*a***.

Sealing means **18*a* comprises a union connector 20 that is adapted to receive and secure therein at one end thereof terminal end 14 of signal transmission tube 12. Union connector 20 also receives and secures therein at the other end thereof the first end of a length of hollow inert tube 22. Inert tube 22 may comprise a plastic tube identical or similar to that of the signal transmission tube 12 but without any reactive material contained therein. Union connector 20 couples the open first terminal end 14 of the signal transmission tube 12 and the first open end of inert tube 22 in signal flow communication. As used herein and in the claims, the term "union connector" refers to a connector which seals the terminal end of a signal transmission tube but permits the signal generated by reaction of the reactive material to pass through or into the union connector, to a surge chamber or other tubing. Accordingly, a signal passing through signal transmission tube 12 and emitted from first terminal end 14 thereof passes through union connector 20, then through inert tube 22 and into an inert closure shell 24. Inert closure shell 24 is secured to the second end of inert tube 22 by a crimp 26. Closure shell 24**, the interior of which provides a surge chamber as described below, may be an aluminum or plastic shell of the kind typically used for detonator caps, but of course is not supplied with any pyrotechnic or explosive or reactive material.

In operation, a signal inadvertently initiated in signal transmission tube 12 will travel rapidly therethrough (at a rate of about 2000 meters per second for shock tube) and will be discharged from the terminal ends 14 and 16 thereof. The discharged signals will pass through union connectors 20, inert tubes 22 into closure shells 24 of sealing means 18*a* and 18*b*. As will be better appreciated with reference to the description below of FIG. 5, the interior of closure shells 24 provide surge chambers which are more than adequate to accommodate and dissipate the increased pressure of the signal front and thereby militate against rupture of the signal transmission tube 12 or inert tube 22 or any of the connections. In the illustrated embodiment, the surge chamber space provided is augmented by the interior volume of inert tubes 22 and of union connectors 20, although experience has shown that such augmentation of the surge chamber capacity provided by the conventionally sized detonator cap shells 24 is usually not needed. The construction of sealing means 18*a* and 18*b*, wherein the inert closure shells 24 have union connectors 20 connected thereto by a short length of inert tubing 22, is primarily useful as facilitating re-use of the sealing means 18*a* and 18*b* when union connectors 20 are made to be readily-disconnected from the terminal ends 14, 16 of transmission tube 12. The releasable feature of the union connector is more fully described below. Union connector 20 and crimp 26 are sufficiently well secured to transmission tube 12 so that the initiation signal does not rupture signal transmission tube 12 or any component of sealing means 18*a*, or eject sealing means 18*a* from first terminal end 14.

Figure 2:
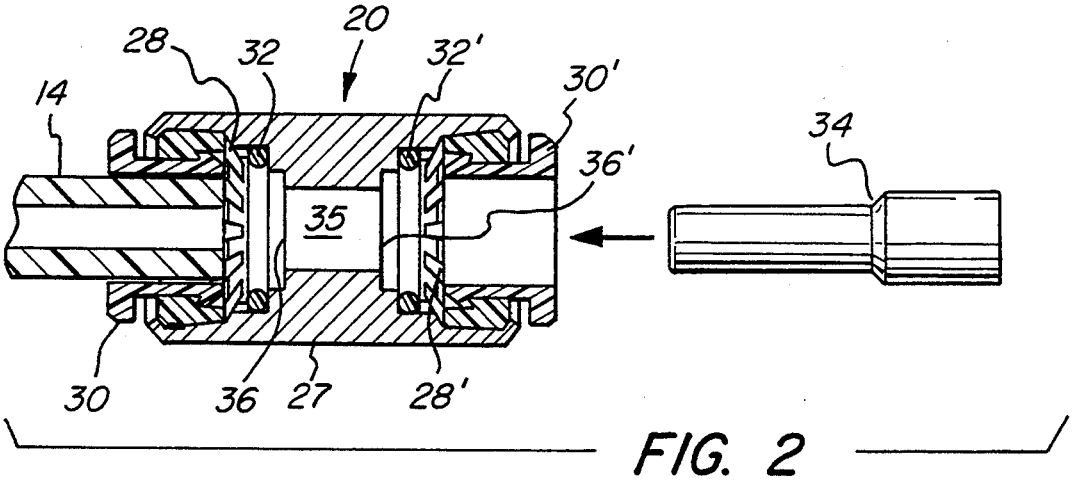
FIG. 2 is an exploded partly cross-sectional view of sealing means in accordance with one embodiment of the present invention comprising a union connector and a plug mounted on the terminal end of a signal transmission tube.

A typical union connector 20 is shown in greater detail in FIG. 2, which illustrates another embodiment of a sealing means usable in an embodiment of the present invention. Union connector 20 is a commercially available connector such as those sold as Parker Fluid Connectors by the Brass Products Division of Parker Hannifin Corporation under the trade designation Parker Prestolok Union 62PL. Generally, union connector 20 comprises a connector body 27 having an axial bore (unnumbered) extending therethrough. Seated within connector body 27 is a resilient annular toothed member 28 which comprises a plurality of gripping teeth extending from its annular body radially inwardly thereof. A button 30 is mounted on connector body 27 and is dimensioned and configured to form an annular wedge which, when pressed against annular toothed member 28, tends to spread the teeth apart. Button 30 has a central aperture defining part of the unnumbered bore extending through connector body 27 and through which the first terminal end 14 of signal transmission tube 12 (FIG. 1) may be inserted to engage the teeth. The unnumbered bore extending through connector body 27 of union connector 20 has a central portion 35 of slightly reduced diameter defined between shoulders 36 and 36'. To remove the tube from the connector, button 30 is pressed to spread the teeth apart, thereby releasing the tube. Preferably, an O-ring 32 is disposed about the longitudinal bore of connector body 27 and provides a sealing fit between first terminal end 14 and union connector 20. The second end of union connector 20 is constructed identically to the first end and comprises a toothed member 28', a button 30' and shoulder 36'. The second end of union connector 20 operates in a manner identical to the first end to receive, for example, one end of inert tube 22 as illustrated in FIG. 1.

However, FIG. 2 represents an alternative embodiment of the invention in which the axial bore of union connector 20 is closed at the second end thereof by the insertion therein of a plug 34 in the direction indicated by the arrow (unnumbered) in FIG. 2. Plug 34 may be dimensioned and configured to be received within button 30' and to seal against O-ring 32' and to be retained therein by toothed member 28'. If plug 34 is dimensioned and configured to be seated against shoulder 36', the chamber within connector body 26 between first terminal end 14 and plug 34 serves as a surge chamber to help disperse an initiation signal emitted from first terminal end 14. Thus, union connector 20 supplied with a plug 34 to close the second end thereof serves as a releasable sealing means which functions in the same manner as sealing means 18*a* and 18*b* illustrated in FIG. 1. In both cases, the sealing means may be quickly removed from the terminal end of the shock tube by simply depressing the button 30 so that toothed member 28 releases the terminal end of the shock tube. This quick release feature enables ready removal and replacement of the sealing means and re-use thereof. Thus, the recipient of a shipment of coils or other bundles of signal transmission tube which have been protected in storage and transit by sealing means such as sealing means 18*a*, 18*b* or the sealing means of FIG. 2, may quickly remove the sealing means from the coils of signal transmission tube and retain them. When a sufficient quantity is collected, the-retained sealing means may be shipped back to the supplier of the signal transmission tubes for re-use.

Figure 3:
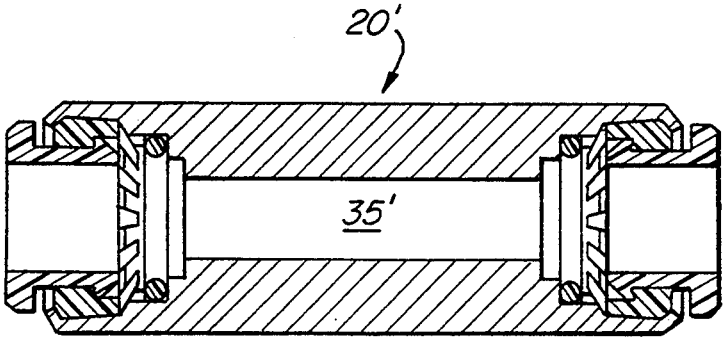
FIG. 3 is a cross-sectional view of a union connector similar to that of FIG. 2, but elongated relative to the union connector of FIG. 2.

To provide a larger surge chamber than that provided by union connector 20, a union connector that provides a longer longitudinal bore may be utilized. For example, union connector 20' of FIG. 3 is of a construction identical to that of union connector 20 of FIG. 2 except that the central portion 35' of the bore extending therethrough is significantly longer than the central portion 35 of the bore of FIG. 2. Union connector 20' of FIG. 3 operates in the same manner as union connector 20 of FIG. 2 while providing a larger internal surge chamber. Accordingly, a longitudinally extended union connector such as union connector 20' is perhaps better suited to be equipped with a plug 34 to serve as a sealing means, whereas the longitudinally shorter version is well-adapted to serve as a component of sealing means such as sealing means 18*a* and 18*b* of FIG. 1. Of course, in either the FIG. 2 or FIG. 3 embodiment, the plug 34 may be hollowed out to enlarge the capacity of the surge chamber provided by union connectors 20 or 20'.

Figure 4:
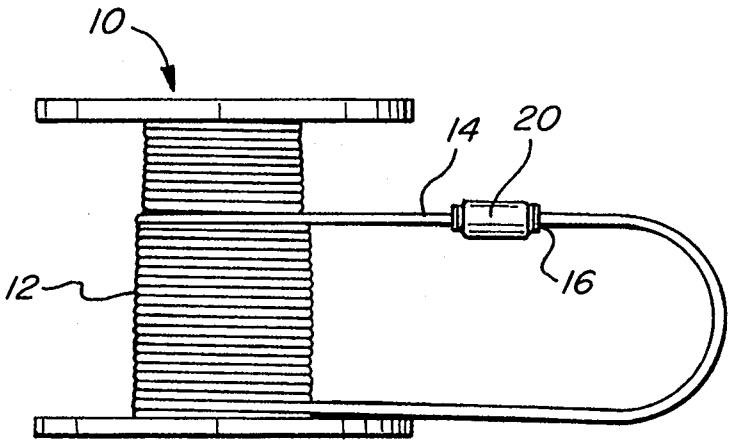
FIG. 4 is a schematic elevational view of a signal transmission tube assembly comprising, in accordance with another embodiment of the present invention, a spool of signal transmission tube fitted with a sealing means which couples the two open terminal ends of the signal transmission tube in signal communication with each other.

According to still another embodiment of the present invention, a sealing means comprising a union connector such as union connector 20, may be used to couple first terminal end 14 to second terminal end 16 of a length, e.g., a coil, of signal transmission tube 12 as shown in FIG. 4. In this configuration, a signal generated by the reaction of the reactive material contained within the coil of signal transmission tube 12 will tend to dissipate by travelling through the closed loop provided by establishing a union connection between the terminal ends 14, 16 of the single length of signal transmission tube 12.

While FIGS. 2 and 3 show one particular type (external) of union connector, sealing means according to the present invention can be provided by any suitable union connector, i.e., a connector which provides a bore therein for the passage of an initiation signal therethrough and which is secured to the signal transmission tube. In this way, a signal that is discharged from a terminal end of a signal transmission tube can pass through the union connector and be appropriately contained and thus prevented from propagating outwardly of the signal transmission tube assembly where it might ignite to another spool of signal transmission tube or work other mischief. Preferably, the generated signal communicates with a surge chamber, which chamber may be located in the union connector and/or within a closure shell. The closure shell may be connected in signal communication with the union connector by a length of inert tubing as illustrated in FIG. 1.

Figure 5:
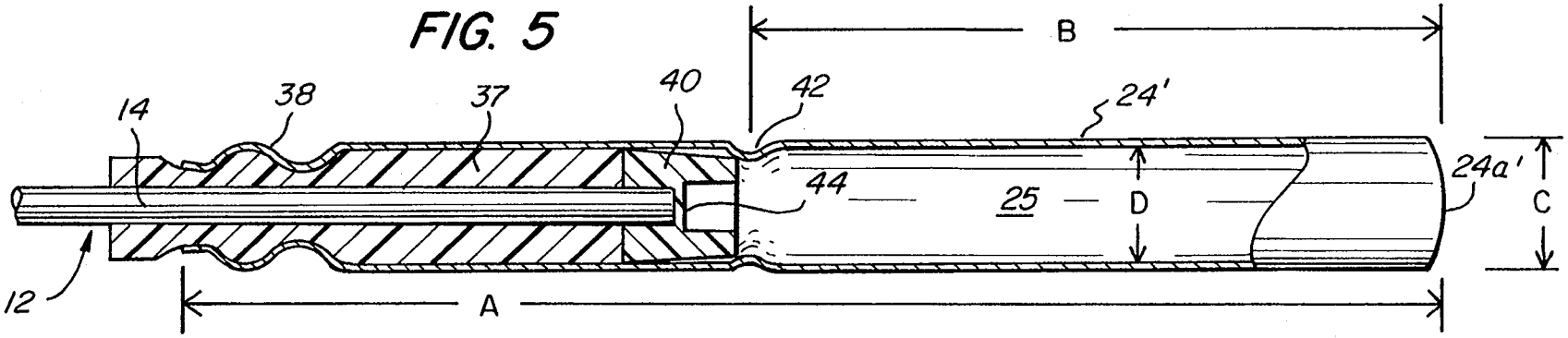
FIG. 5 is a cross-sectional view of sealing means in accordance with another embodiment of the present invention comprising inert elements of a conventional detonator cap mounted on the open terminal end of a signal transmission tube.

FIG. 5 illustrates a specific embodiment of construction of an inert closure shell such as shell 24 of sealing means 18*a* and 18*b*, which may itself serve as a sealing means. As illustrated, the sealing means may comprise a closure shell 24' mounted directly onto one of the terminal ends of the signal transmission tube, e.g., onto first terminal end 14. In this embodiment, the sealing means would be disconnected from the signal transmission tube by cutting the latter, and then sealing means would not be re-usable. (The substitution of a releasable connector connected to an inert tube for the signal transmission tube 12 of FIG. 5 would render the sealing means re-usable as in the embodiment illustrated in FIG. 1.) Closure shell 24' may conveniently be provided by a conventional detonator shell which has a closed end 24*a'* and an open end (unnumbered) for receiving the terminal end 14 of signal transmission tube 12.

The hollow interior of closure shell 24' provides a surge chamber 25. First terminal end 14 is disposed within the open end of closure shell 24' and is retained therein by a closure bushing, which is secured in place by crimp 38. Preferably, the sealing means includes a means to prevent accumulation within surge chamber 25 of loose reactive material which migrates from the interior of signal transmission tube 12. Such migration of reactive material powder is a phenomenon well-known to those skilled in the art as shown by the above-mentioned Kristensen et al U.S. Pat. No. 4,328,753. The presence of accumulated reactive material in surge chamber 25 of closure shell 24' is obviously undesirable. Of course, the means to prevent accumulation of loose or migrating reactive material powder must not also prevent the transmission into the surge chamber of the signal generated by reaction of the reactive material contained within signal transmission tube 12.

Figure 6:
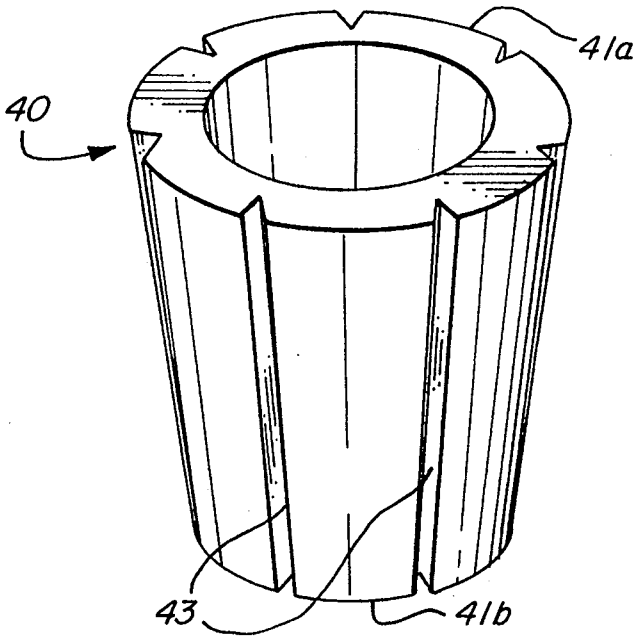
FIG. 6 is a perspective view, greatly enlarged with respect to FIG. 5, of the isolation cup of the sealing means shown in FIG. 5.
Figure 7:
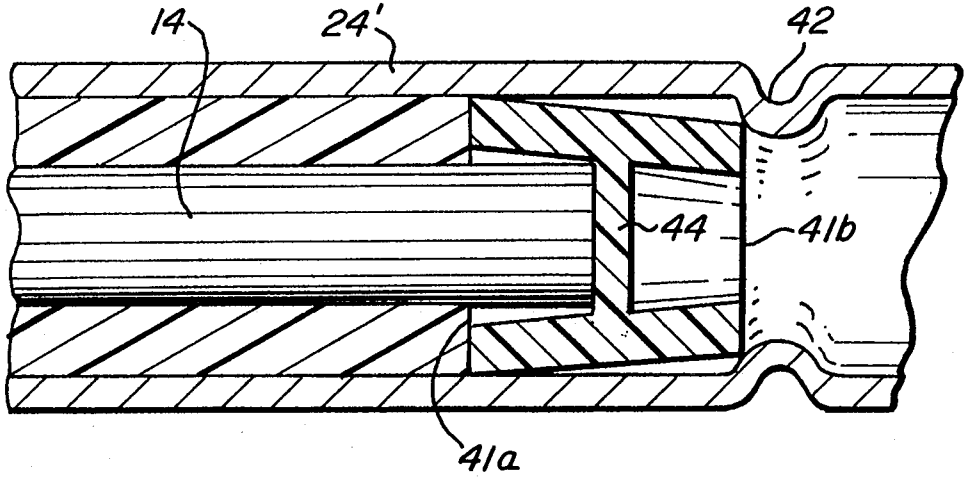
FIG. 7 is a view, enlarged with respect to FIG. 5, of the portion of FIG. 5 showing the terminal end of the signal transmission tube received in the isolation cup.

Any suitable reactive material powder-blocking means ("closure means") may be utilized, such as a thin membrane or diaphragm fitted-between the open end of the signal transmission tube and the surge chamber. Such reactive material closure means may conveniently be provided by a signal-rupturable membrane such as that provided by the isolation cups conventionally used in detonator caps fitted onto shock tubes in order to eliminate static discharge initiation of the detonator caps, as explained in detail in Gladden U.S. Pat. No. 3,981,240. In the embodiment illustrated in FIG. 5 hereof, an isolation cup 40 is utilized. Isolation cup 40, as best seen in FIG. 6, is of generally cylindrical configuration but tapers from a larger diameter at its inlet end 41*a* towards a smaller diameter at its discharge end 41*b*, as may best be appreciated from FIG. 7. As is well-known in the art, a plurality of longitudinally extending grooves 43 provide an air passageway through which air can escape from the interior of closure shell 24', into which isolation cup 40 is inserted. The isolation cup 40 is dimensioned to fit snugly within cap shell 24' and the grooves 43 relieve the air pressure increase engendered by inserting isolation cup 40 into shell 24'. As best seen in FIGS. 5 and 7, a thin membrane or diaphragm 44 is formed at about the longitudinal midpoint of isolation cup 40 and closes the central bore (unnumbered) of isolation cup 40. (Diaphragm 44 is not visible in FIG. 6.) A typical terminal end, terminal end 14, of signal transmission tube 12 is received through the inlet end 41*a* of isolation cup 40 and terminates in close proximity to signal-rupturable diaphragm 44. A crimp 42 (FIGS. 5 and 7) is formed in cap shell 24' to provide a shoulder on which isolation cup 40 is seated. A closure bushing 37 is seated atop the inlet end 41*a* of isolation cup 40 and a crimp 38 (FIG. 5) is formed in cap shell 24' to securely lock closure bushing 37 and the terminal end 14 of signal transmission tube 12 within cap shell 24'. Isolation cup 40, closure bushing 37 and closure shell 24', are common components of non-electric detonator caps and the sealing means of FIG. 5 generally conforms to a conventional non-electric detonator cap, less the explosive and pyrotechnic contrasts thereof. In conventional usage, isolation cup 40 finds utility in preventing the discharge of static electricity from the terminal end of a signal transmission tube received in isolation cup 40 as illustrated. However, the static discharge function is not needed in the sealing means of the present invention.

When assembled as described above, diaphragm 44 serves to prevent loose reactive material powder from migrating from first terminal end 14 of the signal transmission tube 12 into the surge chamber 25 of inert closure shell 24'. As is well-known in the art, diaphragm 44 is easily ruptured by a signal emitted from the end of a signal transmission tube, so that even though diaphragm 44 prevents the migration of loose reactive material into the surge chamber 25, it will not inhibit the passage of a signal emitted from the terminal end 14 of the signal transmission tube 12 into the surge chamber 25.

The signal ruptures the diaphragm 44 which therefore absorbs some of the energy of the signal. In some embodiments of the invention a plurality of such diaphragms may be provided in series to further attenuate the strength of the signal. For example, a plurality of isolation cups 40 may be positioned within surge chamber 25, each retained in place by an appropriate crimp formed in the wall of shell 24'. Alternatively, a plurality of isolation cups 40 could be stacked one atop the other. This latter configuration would be preferred at least insofar as it provides for an easier manufacturing procedure. In lieu of a crimp 42 to retain an isolation cup, or stack of isolation cups in place, a short, hollow sleeve could be inserted into cap shell 24 to extend from closed end 24*a'* thereof. The isolation cup or cups would be supported in place by the end of the sleeve opposite the end which contacts closed end 24*a'*.

Figure 8:
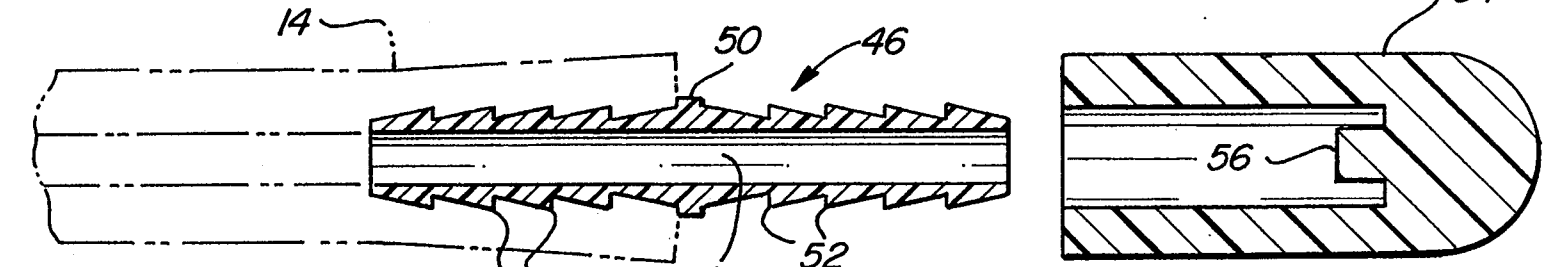
FIG. 8 is a cross-sectional, exploded view of a sealing means comprising an internal connector in accordance with another embodiment of the present invention with an associated signal transmission tube shown in phantom outline.

As illustrated in detail in FIG. 2, union connector 20 engages the exterior of the signal transmission tube. However, alternative embodiments of sealing means in accordance with the present invention may comprise connectors that engage the interior of the signal transmission tube. For example, as shown in FIG. 8, the sealing means may comprise a ribbed connector 46 dimensioned and configured to be inserted within the hollow interior of the open terminal end of a signal transmission tube, e.g., first terminal end 14. A hollow longitudinally extending bore of ribbed connector 46 provides a surge chamber 47. Ribs 48 are dimensioned and configured in a conventional manner to allow relatively easy insertion of connector 46 into the interior of first terminal end 14 and to inhibit withdrawal of connector 46 therefrom. A shoulder 50 provides a stop member to limit the insertion of connector 46 into first terminal end 14. Ribs 52 are dimensioned and configured to allow the relatively easy insertion of the other end of connector 46 into another device, such as a cap member 54, which may include a plug button 56 that is dimensioned and configured to seal the surge chamber 47.

Figure 9:
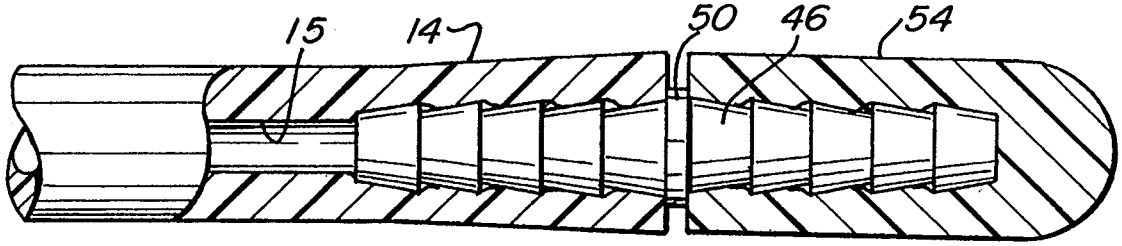
FIG. 9 is a cross-sectional view of the sealing means of FIG. 8 shown assembled and inserted into the open terminal end of a signal transmission tube.

The sealing means of FIG. 8 is shown fully assembled in FIG. 9 in which the reactive material is indicated at 15.

In other embodiments, cap member 54 may be replaced with a length of inert tube to provide an extended surge chamber therein. The tube may be closed at its distal end or may communicate with a closure shell or other device to provide a larger surge chamber, in a manner similar to sealing means 18*a* of FIG. 1.

Generally, the capacity of a surge chamber provided by the unobstructed interior of a detonator cap shell is more than adequate to dissipate the force of the signal generated by reaction of the reactive material so as to prevent rupture of the signal transmission tube or a sealing means connected thereto. For example, typical dimensions of the structure of FIG. 5 attained by utilizing components normally used in the manufacture of non-electric detonator caps are as follows: A=3.5 inches (8.89 cm), B=2.6 inches (6.6 cm), C (outside diameter)=0.296 inches (0.75 cm) and D (inside diameter)=0.261 inches (0.66 cm).

While the invention has been described in detail with reference to particular embodiments thereof, and while certain features of the invention may have been illustrated in some embodiments of the invention and not in others, this is not intended as a limitation on the invention, and it will be apparent that upon a reading and understanding of the foregoing, numerous alterations to the described embodiments will occur to those skilled in the art, and it is intended to include such alterations within the scope of the appended claims.

What is claimed is:

1. A signal transmission tube assembly comprises a signal transmission tube having opposite terminal ends and containing a reactive material, and sealing means connected to both terminal ends of the signal transmission tube to seal the assembly against escape therefrom of a signal engendered by reaction of the reactive material.

2. The assembly of claim 1 wherein the sealing means comprises a union connector sealing one terminal end of the signal transmission tube in signal communication relation with the other.

3. The assembly of claim 1 wherein the sealing means comprises an inert closure means affixed to each of the opposite terminal ends.

4. The assembly of claim 1 wherein the sealing means comprises a first inert closure means affixed to one terminal end and a second inert closure means affixed to the other terminal end.

5. The assembly of claim 3 wherein the sealing means comprises an inert closure means having one end of a length of inert tubing sealed thereto, and a union connector sealing the other end of the length of inert tubing to a terminal end of the signal transmission tube whereby the inert tubing is in signal communication relation with the signal transmission tube.

6. The assembly of claim 1, claim 3, claim 5 or claim 4 wherein the sealing means comprises a releasable sealing means which is capable of being actuated to release the signal transmission tube from the sealing means.

7. The assembly of claim 1, claim 3, claim 5, or claim 4 wherein the signal transmission tube is coiled on a spool.

8. The assembly of claim 1, claim 3, claim 5 or claim 4 wherein the sealing means comprises a surge chamber connected in signal communication with the signal transmission tube.

9. The assembly of claim 8 wherein the sealing means comprises a releasable sealing means which is capable of being actuated to release the signal transmission tube from the sealing means.

10. The assembly of claim 9 further including a signal-rupturable diaphragm interposed between the signal transmission tube and the surge chamber.

11. A signal transmission tube assembly comprises a signal transmission tube having opposite terminal ends and containing a reactive material, first sealing means connected to one terminal end of the signal transmission tube and second sealing means connected to the other terminal end of the signal transmission tube, the first and second sealing means serving to seal the assembly against escape therefrom of a signal engendered by reaction of the reactive material, at least one of the first and second sealing means comprising an inert closure means having a surge chamber connected in signal communication with the signal transmission tube.

12. The assembly of claim 11 wherein both the first and second sealing means comprise inert closure means having a surge chamber connected in signal communication with the signal transmission tube.

13. The assembly of claim 11 or claim 12 further including a signal-rupturable diaphragm interposed between the signal transmission tube and the surge chamber of the sealing means.

14. The assembly of claim 13 wherein the sealing means comprises a releasable inert closure means which is capable of being actuated to release the signal transmission tube from the inert closure means.

* * * * *

UNITED STATES PATENT AND TRADEMARK OFFICE

CERTIFICATE OF CORRECTION

PATENT NO. : 5,413,046

DATED : May 9, 1995

INVENTOR(S) : Brian R. Sobczak et al

It is certified that error appears in the above-indentified patent and that said Letters Patent is hereby corrected as shown below:

In column 1, line 17, replace "to-as" with --to as--.
In column 3, line 46, replace "spool By" with --spool. By--.
In column 5, line 27, replace "readily-disconnected" with --readily disconnected--.
In column 6, line 12, replace "26" with --27--.
In column 6, line 31, replace "the-retained" with --the retained--.
In column 7, line 36, replace "a closure bushing" with --closure bushing 37--.
In column 7, line 53, replace "fitted-between" with --fitted between--.

Signed and Sealed this

Seventh Day of November, 1995

Bruce Lehman

*Attest:*

BRUCE LEHMAN

*Attesting Officer*

*Commissioner of Patents and Trademarks*